US008246495B2

(12) United States Patent
James

(10) Patent No.: US 8,246,495 B2
(45) Date of Patent: Aug. 21, 2012

(54) BAT CONDITIONING DEVICE AND METHOD

(75) Inventor: John James, Menlo Park, CA (US)

(73) Assignee: Refuse2Lose LLC, Menlo Park, CA (US)

( * ) Notice: Subject to any disclaimer, the term of this patent is extended or adjusted under 35 U.S.C. 154(b) by 18 days.

(21) Appl. No.: 12/271,687

(22) Filed: Nov. 14, 2008

(65) Prior Publication Data

US 2009/0069127 A1 Mar. 12, 2009

Related U.S. Application Data

(63) Continuation-in-part of application No. 11/419,392, filed on May 19, 2006, now abandoned.

(51) Int. Cl.
*A63B 69/00* (2006.01)

(52) U.S. Cl. ..... 473/451; 223/78

(58) Field of Classification Search ..... 473/415, 473/424, 451; D21/698; D8/77; 223/78
See application file for complete search history.

(56) References Cited

U.S. PATENT DOCUMENTS

| | | | | | |
|---|---|---|---|---|---|
| 3,743,297 | A | * | 7/1973 | Dennis | 473/242 |
| 3,907,287 | A | | 9/1975 | Fox et al. | |
| 3,942,793 | A | * | 3/1976 | Lombardo | 473/451 |
| 4,846,472 | A | | 7/1989 | Terza | |
| 4,943,055 | A | * | 7/1990 | Corley | 473/451 |
| 5,092,588 | A | * | 3/1992 | DeLuca | 482/44 |
| 5,230,506 | A | | 7/1993 | Cipriano et al. | |
| 5,238,241 | A | | 8/1993 | Christensen | |
| 5,265,871 | A | * | 11/1993 | Hanley | 473/415 |
| 5,421,493 | A | | 6/1995 | Ebeling, II | |
| 5,588,648 | A | * | 12/1996 | Stebbins | 473/451 |
| 5,638,999 | A | * | 6/1997 | Greene | 223/78 |
| 6,024,660 | A | * | 2/2000 | Romanick | 473/596 |
| 6,138,879 | A | * | 10/2000 | Breuner | 223/78 |
| 6,435,989 | B1 | * | 8/2002 | Grubman | 473/422 |
| 2007/0202968 | A1 | * | 8/2007 | Zappel et al. | 473/424 |

OTHER PUBLICATIONS

Webpage download, BatHammer, 2011, http://www.r2lonline.com/prodPageBatHammer.html#, 2 pages.*
Webpage download, Softballfans, 2004, www.softballfans.com/forums/showthread.php?t=15980, 4 pages.*
Webpage download, Softballfans, 2007, http://www.softballfans.com/forums/showthread.php?t=350367, 6 pages.*
Webpage download, Softballfans, 2003, http://www.softballfans.com/forums/showthread.php?t=2940, 3 pages.*
Webpage download, Softballfans, 2004, http://www.softballfans.com/forums/showthread.php?t=18650, 5 pages.*

(Continued)

*Primary Examiner* — Gene Kim
*Assistant Examiner* — M Chambers
(74) *Attorney, Agent, or Firm* — Lowe Graham Jones PLLC

(57) ABSTRACT

A bat conditioning device for breaking in or seasoning softball or baseball bats. A preferred conditioning device includes a handle having a first end and a second end, a grip attached to the first end of the handle, and a head attached to the second end of the handle having an impact response that mimics that of a regulation softball. In the preferred form, the head is a regulation softball. The bat conditioning device is of a length that allows softball bats to be broken-in by striking a bat held in one hand of a user, with the conditioning device being held in the other hand.

15 Claims, 5 Drawing Sheets

OTHER PUBLICATIONS

Webpage download, Softballfans, 2004, www.softballfans.com/forums/showthread.php?t=5901, 5 pages.*

Curtis Matthew Cruz, "Characterizing Softball Bat Modifications and Their Resulting Performance Effects," Master of Science in Mechanical Engineering, Washington State University, Department of Mechanical and Materials Engineering, Nov. 16, 2006.

Webpage download, Sobftballfans, 2004, http://www.softballfans.com/forums/showthread.php?2=11108, 44 pages.

* cited by examiner

BAT CONDITIONING DEVICE AND METHOD

PRIORITY CLAIM

This application is a continuation-in-part of U.S. application Ser. No. 11/419,392, filed May 19, 2006.

FIELD OF THE INVENTION

This invention relates generally to sports equipment and, more specifically, to bat conditioning devices and methods.

BACKGROUND OF THE INVENTION

Bats used by softball and baseball players often require some form of break-in or conditioning period before they can reach their potential as advertised by the bat manufacturer. Ideally, this must be done without damaging the bat, such as by causing micro-tears, dents, or fractures in the bat.

Aluminum and composite bats make up the majority of bats sold and they are hollow. Because they are hollow the barrel compresses somewhat like a spring during impact with the ball. This improves the collision efficiency and allows the bat barrel to temporarily store and return energy to the ball that would have been lost to heat as the ball compresses and relaxes during its collision with the bat. This is widely referred to as the trampoline effect. The more elastic the bat the greater the trampoline effect in the barrel. Conversely, if the bat barrel is stiffer, the trampoline effect in the barrel is less effective.

Experimental evidence has shown that the performance of composite and aluminum bats appears to improve with use, suggesting that the spring-action of the barrel improves as the bat is broken in. Bat manufacturers recommend breaking in their bats by hitting softballs or baseballs in a way that causes them to strike the bat in a particular pattern, so the bat will be broken in evenly. Breaking in a bat by hitting softballs or baseballs takes a considerable amount of time because the balls must be pitched by a person on a playing field. Balls being pitched by a machine in a batting cage typically are not game balls, but rather are made of closed pore foam that does not affect the bat in the same way and can be compressed with medium effort. Consequently, using a bat with such batting practice balls will take months to break in the bat, if at all.

Time and fatigue limitations make it extremely difficult to break in a bat quickly and properly. It is also impossible to accurately follow the suggested break-in pattern in the manner recommended by the bat manufacturers because of the uncertainty about where the softball or baseball will strike the bat. As a result the bat becomes unevenly flexible in some areas and stiff in others, impairing bat performance.

Therefore, there is a need for a device that allows quick and accurate conditioning of a softball bat while replicating the effect of a ball striking the bat.

SUMMARY OF THE INVENTION

A bat conditioning device includes a handle having a ball or like object secured to or formed on one end. In a preferred example of the invention, the handle has a first end and a second end, with a grip attached to the first end of the handle and a standard regulation softball or baseball attached to the second end.

The "ball" may alternatively be formed in any shape, preferably from a material that is firm, yet yields slightly on impact in a way that is similar to the manner in which a standard regulation softball reacts when striking a hard surface. The bat conditioning device is of a length that allows softball bats to be broken-in by striking a bat held in one hand of a user with the bat conditioning device held in the other hand, thus allowing quick and accurate conditioning of a softball bat while replicating the effect of a softball striking the bat.

In an even more preferred version, a bat conditioning device includes a handle having a weight secured to the end, with a regulation ball secured adjacent the weight. The length of the handle (or shaft) and the size of the weight combine to enable a user to impart a greater force on the bat, thereby more closely replicating the impact of an actual ball when struck by the bat and properly conditioning the bat.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

Figure 1A:
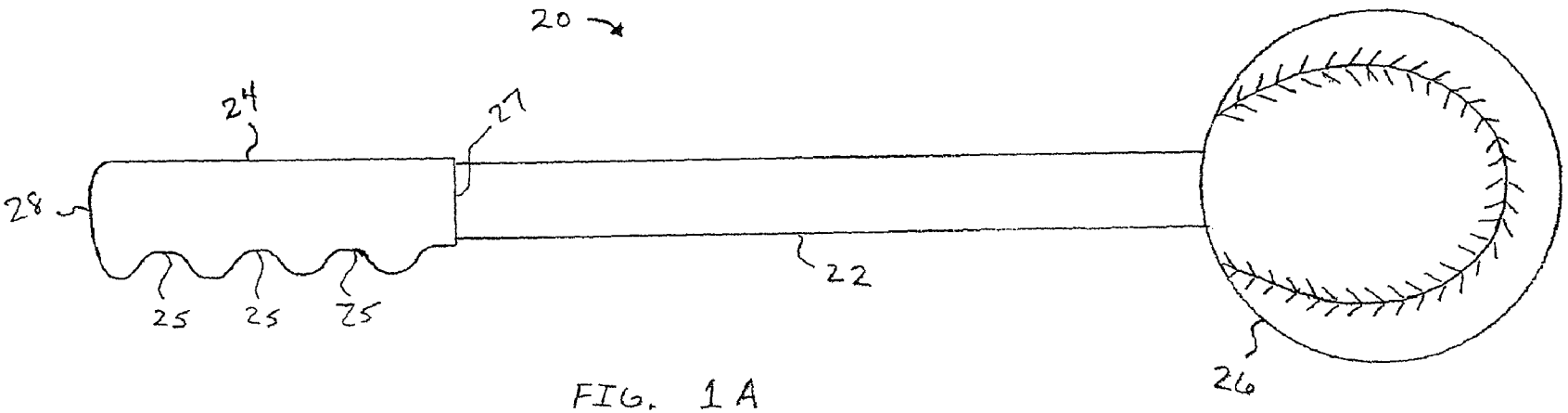
FIG. 1A is a side view of a preferred bat conditioning device in accordance with an embodiment of the present invention.

FIG. 1A is a diagram showing a side view of a bat conditioning device 20 in accordance with a preferred embodiment of the present invention. The bat conditioning device 20 includes an elongated handle 22 having a first end and a second end. In this embodiment, the handle 22 is a hollow metal tube. However, the handle 22 may be formed from any of a variety of materials, such as a solid metal rod, solid or hollow plastic, wood, composites, or other materials. The handle may also be threaded or partially threaded, have a non-circular cross-section, or include one or more angles or curves between the first and second ends.

A ball 26 is secured to the second end of the handle 22. As shown, the ball is in the form of an actual regulation softball or baseball to serve as the working end of the conditioning device. In other forms of the invention, the working end of the device comprises a head that is at least partially rounded and has hardness and resiliency that approximates that of a baseball or softball.

Figure 1B:
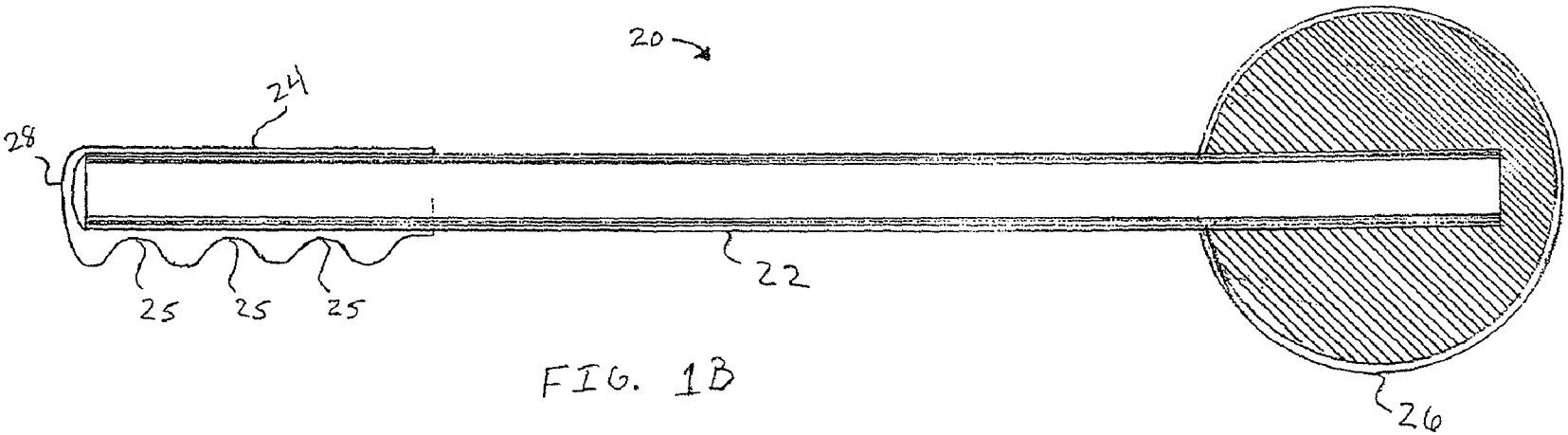
FIG. 1B is a cross-sectional view of the bat conditioning device shown in FIG. 1A.

The first end of the handle 22 provides a means for grasping the device when in use. In the simplest form, no particular grip is required and the user can simply grasp the first end of the handle. In preferred examples of the invention, a grip is formed on or attached to the first end of the handle. As shown in FIGS. 1A and 1B, a grip 24 having an open end 27 and a closed end 28 is attached to the first end of the handle 22. The handle 22 enters the open end 27 of the grip 24 and extends through the grip 24 to a position near the closed end 28. The grip 24 is formed in such a way that the handle 22 fits tightly within the grip 24 and will not slide out of the grip 24 during normal usage of the bat conditioning device 20. An adhesive, threads, tongue and groove, or other arrangements may be used between the handle 22 and the inner surface of the grip 24 to further hold the grip 24 fixedly in place on the handle 22 if desired. The grip 24 includes a plurality of finger grooves 25 to allow the device to be firmly grasped. However, in other embodiments, the finger grooves may not be present or may be formed in a different manner. The grip 24 is formed of a polymer material and is approximately four inches long, but it may be formed of other materials and be different lengths in other embodiments. The grip 24 may also be an integral part of the handle 22 in still other embodiments.

FIG. 1B is a cross-sectional view of the bat conditioning device 20 shown in FIG. 1A. The second end, or working end, of the handle 22 is attached to a softball 26. The second end of the handle 22 extends approximately seven eighths of the way into the softball, with the first end of the handle extending radially outward. However, the handle 22 may extend within the softball 26 to greater or lesser depths as appropriate to ensure that the ball is secured to the handle. In this embodiment, the softball 26 is a standard regulation softball with a circumference of approximately 12 inches that has been drilled to allow a tight press-fit insertion of the handle 22 in such a way that the handle 22 remains held fixedly in place within the softball 26 during normal usage of the bat conditioning device 20. However, in other embodiments, an adhesive may be used between the handle 22 and the softball 26 to further hold the softball 26 fixedly in place on the handle 22. In still other examples, the ball may be attached by using fasteners, internal threading, or other means.

In another example of the invention, the ball 26 is attached to the handle 22 without the use of a central bore. In such an example, an external clamp attached to the handle surrounds all or a portion of a circumference of the ball in order to secure the ball to the handle. The clamp may provide merely a frictional attachment, or may include supplemental means of securement such as one or more protrusions extending into the ball.

Although a regulation softball with a circumference of approximately 12 inches is used in the preferred embodiment because it is the most common size, other sized objects are used in other embodiments. For example, a softball with an 11 inch circumference may be used in other embodiments because softballs of that size are used in some women's and youth leagues. Additionally, a larger softball with a circumference of approximately 16 inches may be used because such larger softballs are common in softball leagues in the Chicago area and some other locations.

Other embodiments may use a wholly or partially rounded object other than a standard regulation softball that is able to approximately mimic the response of a standard regulation softball and is formed such that it is firm, yet yields on impact in a way that is similar to the manner in which a standard regulation softball reacts when striking a hard surface. An object that is not completely spherical may also be used in place of the softball 26, so long as the object has a striking face that is formed in such a way that it is firm, yet yields slightly on impact in a way that is similar to the manner in which a softball reacts when striking a hard surface and can approximate the effect of a softball striking a surface when the bat conditioning device 20 is used. As one example, a cut away portion of a softball, such as a half or a quarter of a softball, could be secured to the handle or encased in plastic or other materials and then secured to the handle. In such a fashion, the head of the device can approximate the resiliency response of a softball even though a softball is not used for the head. As another example, a working head formed from rubber or other materials for an exterior surface can encase one or more other internal materials in order to mimic the resiliency of a softball.

In other embodiments, the second end of the handle 22 also may be shaped in such a way that allows insertion of the handle 22 into the softball 26 with a force less than that required to remove the handle 22 from the softball 26. An example would be for the second end of the handle 22 to include a series of concentric protrusions which are angled on the side of each ridge that faces the softball during insertion, but have a surface that is approximately perpendicular to the axis running along the length of the handle 22 on the other side of each ridge, thus allowing for easier insertion than removal of the handle 22 from the softball 26. In this embodiment, the preferred overall length of the bat conditioning device 20 is approximately 16 inches. The length of the bat conditioning device 20 may differ in other embodiments, but still is such that a user of the bat conditioning device 20 is able to hold a softball bat in one hand and the bat conditioning device 20 in the other hand while using the bat conditioning device 20, thus allowing quick and accurate conditioning of a softball bat while replicating the effect of a softball striking the bat.

Figure 2:
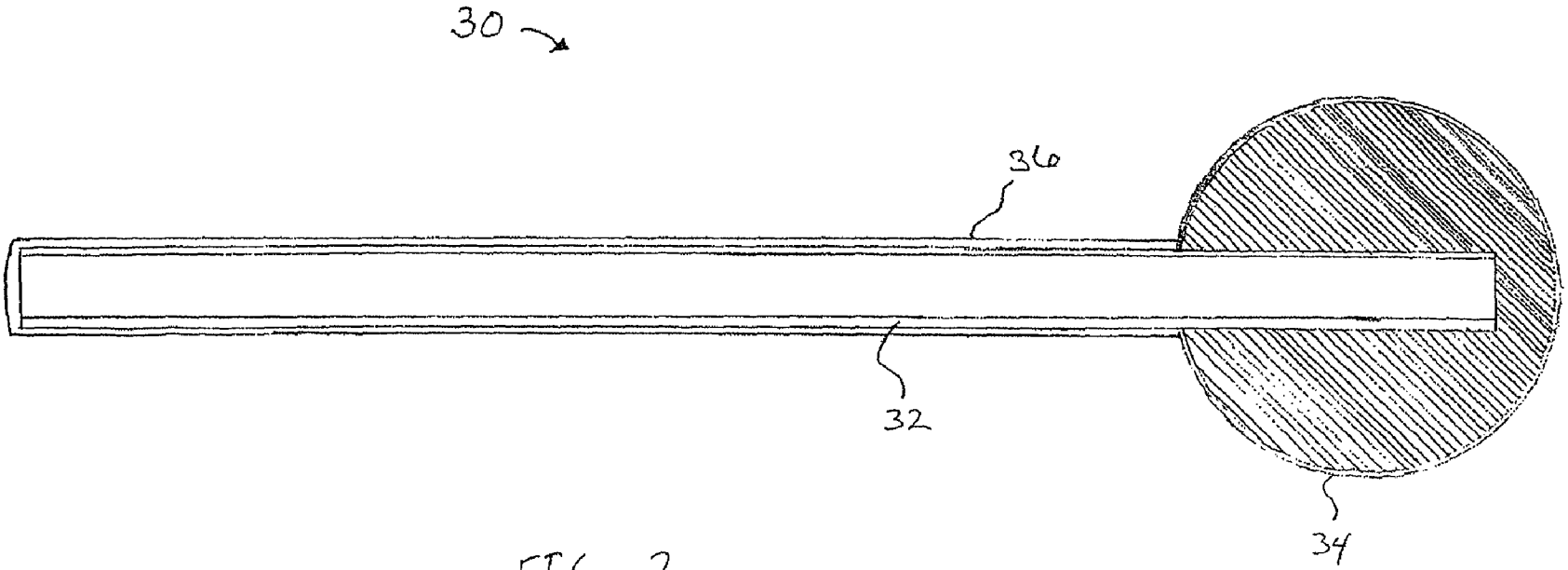
FIG. 2 is a cross-sectional view of a bat conditioning device in accordance with an additional embodiment of the invention.

FIG. 2 is a cross-sectional view of a bat conditioning device 30 in accordance with another example of the invention. The bat conditioning device 30 has some structural similarities to the bat conditioning device 20, in that a handle 32 having a first end and a second end is attached to a softball 34 in similar manner to the way the handle 22 is attached to the softball 26. Additionally, the sizes and materials of the handle 32 and the softball 34 are similar to those for the handle 22 and the softball 26. However, rather than using a grip at the first end of the handle 32, the bat conditioning device 30 includes an external cushioning layer 36 that is wrapped around substantially the entire length of the handle 32 that is not inserted in the softball 34. Preferably, the cushioning layer 36 also covers the tip of the first end of the handle 32. The cushioning layer may be formed from neoprene that is adhered to the handle, or may comprise rubber, silicone, foam, or other materials that are secured to the handle. The cushioning layer 36 provides a secure, cushioned grip for a user of the bat conditioning device 30. In some embodiments, the cushioning layer 36 may extend partially or fully along the portion of the handle 32 that is inserted in the softball 34. Also, variations with respect to the handle 32 and the softball 34 such as those mentioned with respect to FIGS. 1A and 1B are similarly possible in embodiments having a layer covering the handle.

Figure 3A:
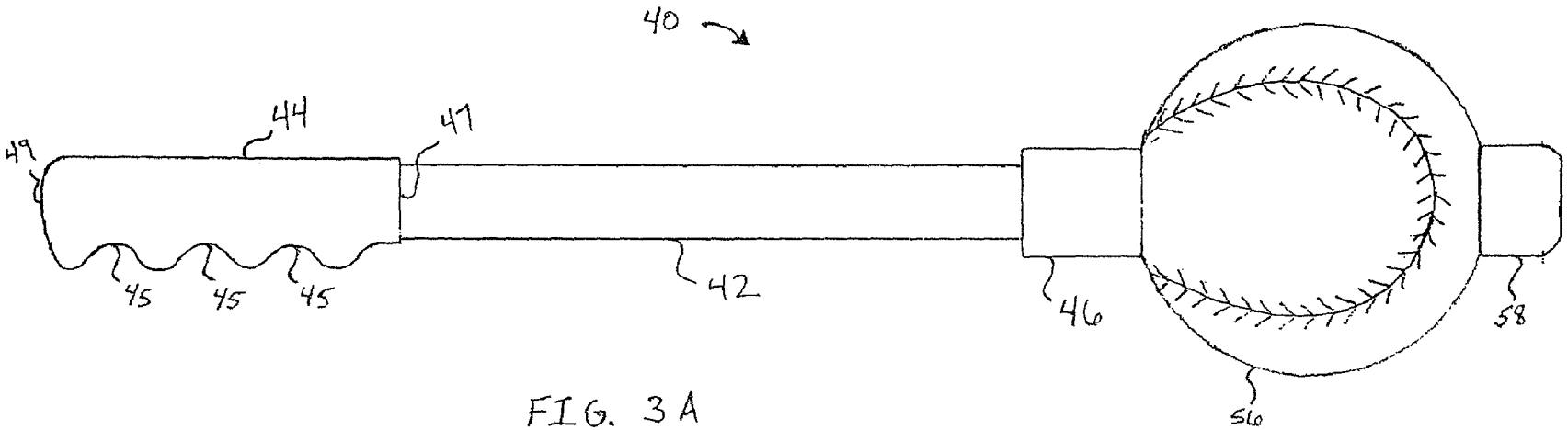
FIG. 3A is a side view of a bat conditioning device in accordance with a further embodiment of the invention.

FIG. 3A is a diagram showing a side view of a bat conditioning device 40 in accordance with a further embodiment of the invention. The bat conditioning device 40 includes a handle 42 having a first end and a second end. The first end of the handle 42 includes a grip 44 that is similar to the grip 24 described for FIGS. 1A and 1B, including an open end 47, a closed end 49, and a plurality of finger grooves 45 to allow for a secure grip. The handle and grip may also be varied in the manner discussed above with respect to prior examples of the invention.

Figure 3B:
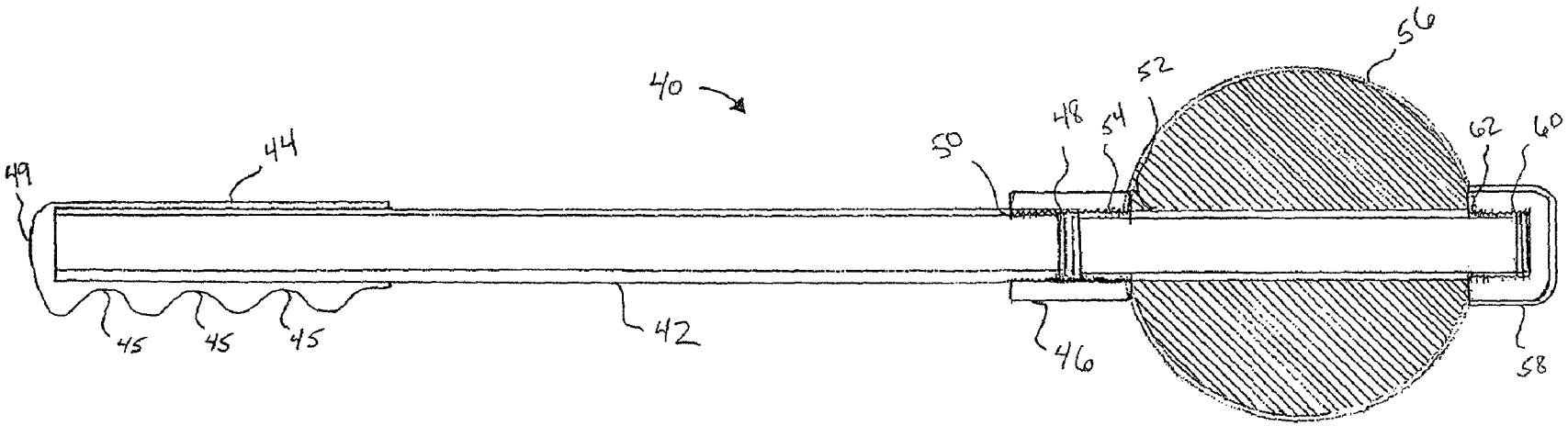
FIG. 3B is a cross-sectional view of the bat conditioning device shown in FIG. 3A.

FIG. 3B is a cross-sectional view of the bat conditioning device 40 shown in FIG. 3A. In the example of FIGS. 3A and 3B, the handle 42 includes a first series of external threads 50 at the second end of the handle 42. An internally threaded coupler 46, such as a nut, pipe coupling, or other fastener with internal threads 48 engages the first series of threads 50.

A pin 52 having an externally threaded first end 54 and externally threaded second end 60 is attached to the coupler via engagement of the first threaded end and the internal threads of the coupler. The pin 52 extends through a bore in the softball 56. In this form of the invention, the pin and bore extend fully through the softball, in contrast with prior embodiments in which the bore preferably extended only partially through the ball. The second end of the pin engages a cap 58 having internal threads 62 that engage the external threads 60 of the pin.

The threaded configuration of the pin and handle, together with the use of the coupler and cap, allow the ball to be secured to the handle. By turning the coupler or cap in the appropriate directions, additional force can be exerted on the ball to more firmly hold it in place. Conversely, by loosening either the cap or coupler fully, the ball can be removed and replaced if desired.

In an additional embodiment, the bat conditioning device 40 does not have a grip 44 attached to the first end of the handle 42, but instead has an additional end cap attached to the first end of the handle 42 that is held in place by matching sets of threads in similar fashion to the way the end cap 58 is held in place on the holding element 52.

In any of the foregoing embodiments, the softball may be replaced by a baseball or by a tool head having at least a partially rounded surface that is configured to mimic the response of a softball when the tool head strikes a bat.

Figure 4:
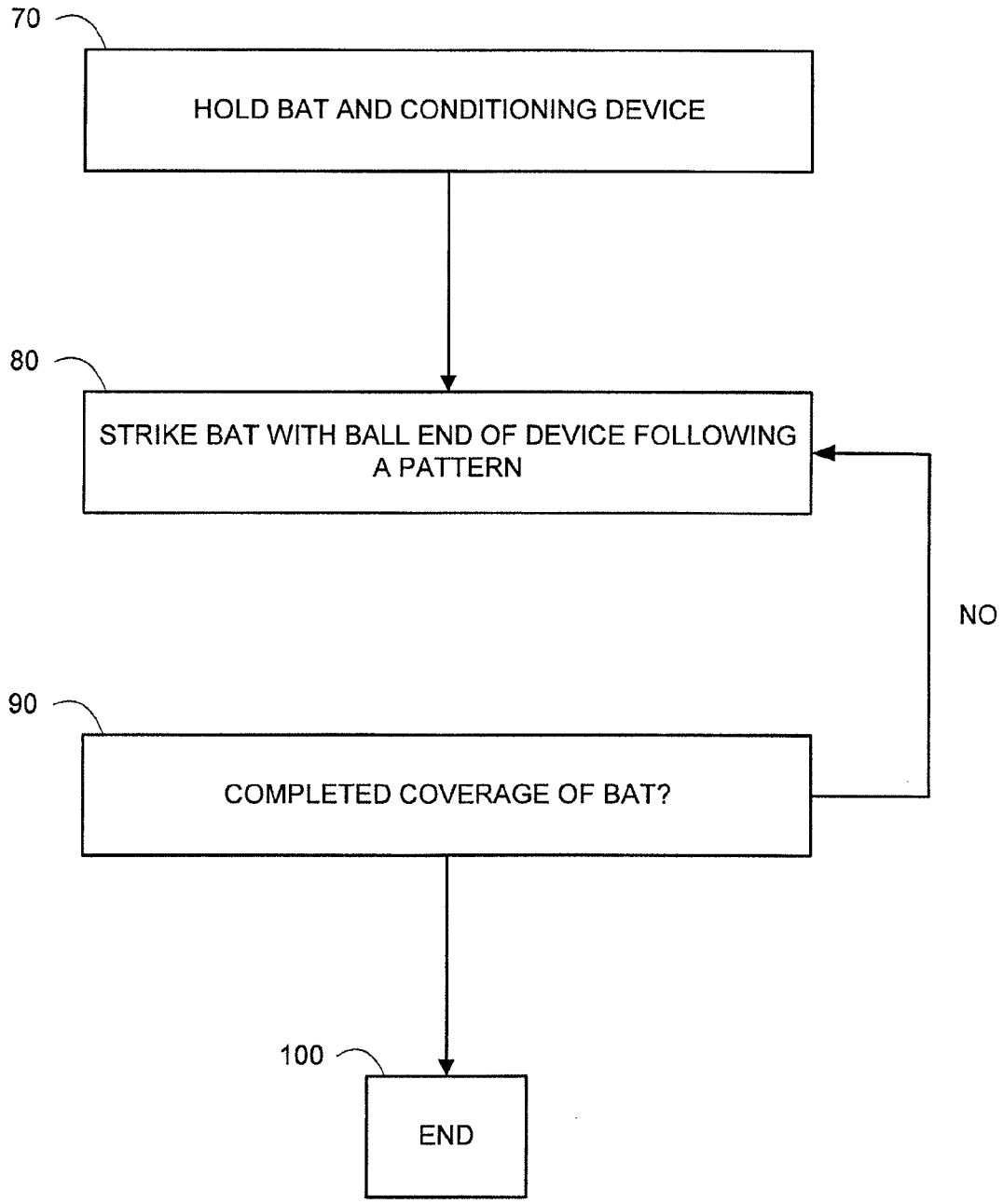
FIG. 4 is a flow diagram illustrating a preferred method for using the bat conditioning device.

FIG. 4 illustrates a preferred method for using the bat conditioning device. As a first step 70, a user holds the bat in one hand using a firm but comfortable grip. The user holds the bat conditioning device 20 in the other hand and, at a second step 80, begins to strike the bat such that the ball will impact the bat. The user should strike the bat with just enough force to feel it absorb the impact of the softball 26. Use of excessive force in striking the bat is not recommended. The user continues to strike the bat using the bat conditioning device 20 using a break-in pattern suggested by the manufacturer of the bat. If no pattern is suggested, the user will follow a pattern intended to provide impacts of the ball against the bat in a uniform pattern along the surface area of the bat that is likely to impact the ball during use. For example, the user starts at the barrel end of the bat and work toward the handle end of the bat on one side, using a series of evenly spaced blows. The user then rotates the bat ¼ turn and repeats the succession of blows along the newly presented side of the bat. This process would be continued until the user had struck a succession of blows around the entire length and circumference of the bat. A total of between 75 and 125 blows may be used in an initial bat break-in, for example. However, for a more seasoned feel, additional strokes may be used to achieve the desired result. As another example, the entire bat may be conditioned using the above pattern two or three times or more. The bat conditioning device 20 may also be used in break-in patterns other than those listed above, such as by using greater or lesser blows, or by moving from the handle to barrel end or by working in a circular or spiral pattern, for example.

Figure 5:
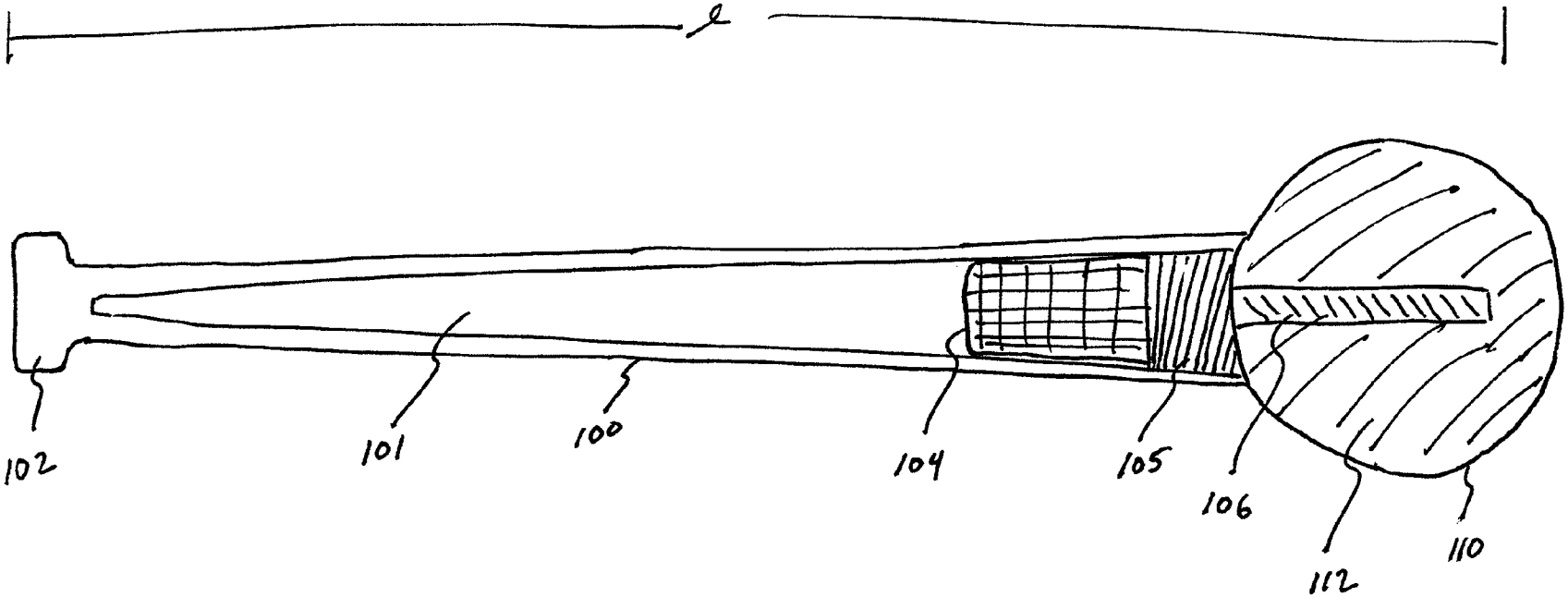
FIG. 5 is a cross-sectional view of an alternate preferred bat conditioning device.

FIG. 5 depicts a preferred alternate version of a bat conditioning device. This alternate version takes advantage of certain weight and length features in order to more closely approximate the impact a bat is likely to experience with a ball in actual use. While the bat conditioning devices of FIGS. 1-3 may be suitable in certain instances, the version of FIG. 5 is better able to impart a desired force and therefore better able to condition a bat properly. Thus, in the preferred version of FIG. 5, the bat conditioning device is sized and configured to impart a force consistent with that generated by a person swinging a bat.

In use, a bat strikes a ball with approximately 6100 pounds of force. An average swing for a softball player is in the range of 81 to 86 mph. In versions incorporating a ball or mallet head secured to the end of a dowel or similar handle, the bat conditioning device will not work ideally to condition the bat. Thus, in the version of FIG. 5, the bat conditioning device includes an additional weight secured to the working end of the device.

As shown, the device includes a handle 100 having a knob at a grip end 102 and having an opposite working end to which a ball 110 is secured. The handle 100 is preferably formed from aluminum and includes a hollow interior 101. The use of aluminum or other metals facilitates the secure attachment of a weight 104 provided at the working end of the handle. Preferably, the weight 104 is formed from steel and includes an externally threaded section 105 that is secured to mating internal threads within the working end of the handle. The weight also includes a shaft, preferably in the form of a threaded bolt 106, extending away from the handle. In the preferred version, the bolt 106 is integrally formed with the weight 104 and extends axially away from the handle. A ball 110, preferably a regulation softball, is secured to the threaded end of the bolt 106, with a layer of epoxy further provided to hold the ball to the bolt.

The handle includes a length and the ball has a diameter, which combine to produce an overall length l for the bat conditioning device. The handle is preferably in the range of 30-50 cm, and more preferably in the range of 35-45 cm, and yet more preferably between 40-45 cm. In one actual embodiment, the handle is 43.2 cm.

The weight provided at the working end of the shaft helps to generate a force similar to that experienced by an actual ball being hit. Preferably the weight 104 is in the range of 0.4 to 0.7 kg, more preferably between 0.5 to 0.6 kg. In one embodiment, the weight is 0.555 kg.

The handle also adds to the overall weight, and in one version the handle is approximately 0.25 kg. Combined with the ball and the weight, the device in one version totals about 1 kg.

The version of FIG. 5 also employs a tapered shape for the handle, being narrowest adjacent the knob end 102 and increasing in diameter at the working end. In one version, the diameter of the handle is about 1.8 cm just above the knob and about 3.7 cm at the working end adjacent the ball. In an alternate embodiment, the handle is tapered from about 3.1 cm at the working end down to 1.2 cm at the handle. Additional suitable embodiments are possible within these dimensions and also outside these ranges. In one preferred form, the diameter of the working end is between about 2 to 3 times the diameter at the knob end in order to better absorb the impact upon striking.

In a preferred method of using the bat hammer, only the sweet spot of the bat is hit with the bat hammer. The sweet spot is typically a region at the barrel end of the bat extending axially for a length of about two to six inches. Preferably the bat hammer is used to impart a force of about 6000 pounds force along the sweet spot (rotating the bat and hitting all along the sweet spot) for a total of at least 250 impacts and preferably for about 500 impacts.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bat conditioning device comprising:

a handle having a first end and a second end;

a shaft extending away from the second end;

a ball secured to the shaft adjacent the second end of the handle; and a weight aligned with and secured to the second end of the handle or to the ball, the weight being in the range of 0.5 to 0.6 kg;

wherein the ball is a standard regulation softball or baseball.

2. The bat conditioning device of claim 1, wherein the weight is threadably secured to the second end of the handle, the shaft further comprising a bolt secured to the weight and extending axially away from the second end of the handle.

3. The bat conditioning device of claim 2, wherein the ball is secured to the bolt, and further comprising a layer of epoxy securing the ball to the bolt.

4. The bat conditioning device of claim 1, wherein the bat is formed from aluminum and comprises a hollow interior, and further wherein the weight is formed from steel.

5. The bat conditioning device of claim 4, wherein the weight is secured to the second end of the handle, the weight further comprising a bolt integrally formed with the weight and extending away from the second end of the handle, the ball being secured to the bolt.

6. The bat conditioning device of claim 1, wherein the weight is about 0.555 kg.

7. The bat conditioning device of claim 6, wherein the weight is integrally formed with the handle.

8. The bat conditioning device of claim 1, wherein the handle has a length defined from the first end to the second end, the length being in the range of 30 to 50 cm.

9. The bat conditioning device of claim 1, wherein the handle has a length defined from the first end to the second end, the length being in the range of 40 to 45 cm.

10. The bat conditioning device of claim 1, wherein the handle is tapered from a first diameter at the first end to a second diameter at the second end, the first diameter being about two to three times smaller than the second diameter.

11. The bat conditioning device of claim 1, wherein the handle is tapered from a first diameter at the first end to a second diameter at the second end, the first diameter being about 1.8 cm and the second diameter being about 3.7 cm.

12. A method for conditioning a bat using the device of claim 1, comprising:

a) providing a bat conditioning device;

b) holding a bat to be conditioned; and c) striking the bat with the bat conditioning device along a sweet spot of the bat, repeating the step of striking the bat between about 250 and about 500 times.

13. The method of claim 12, wherein the length of the handle is in the range of 40 to 45 cm.

14. The method of claim 13 wherein the weight is secured to the second end of the handle, the weight further comprising a bolt integrally formed with the weight and extending away from the second end of the handle, the ball being secured to the bolt.

15. The method of claim 14, wherein the handle is tapered from a first diameter at the first end to a second diameter at the second end, the first diameter being about two to three times smaller than the second diameter.

* * * * *